US005367470A

United States Patent [19]

Lang

[11] Patent Number: 5,367,470

[45] Date of Patent: Nov. 22, 1994

[54] METHOD FOR FUEL FLOW DETERMINATION AND IMPROVING THERMAL EFFICIENCY IN A FOSSIL-FIRED POWER PLANT

[75] Inventor: Fred D. Lang, Livermore, Calif.

[73] Assignee: Exergetics Systems, Inc., Richmond, Calif.

[21] Appl. No.: 835,719

[22] Filed: Feb. 12, 1992

Related U.S. Application Data

[63] Continuation-in-part of Ser. No. 450,686, Dec. 14, 1989, abandoned, which is a continuation of Ser. No. 905,157, Jun. 25, 1992, abandoned, which is a continuation of Ser. No. 112,862, Aug. 25, 1993.

[51] Int. Cl.[5] ..... F23N 5/00; F23N 5/18; G06F 15/46

[52] U.S. Cl. ..... 364/498; 364/494; 364/510; 364/148; 73/23.31; 73/25.01; 431/12

[58] Field of Search ..... 364/509, 510, 498, 499, 364/494, 557, 148, 152, 153; 73/23.31, 23.32, 25.01, 204.18; 374/43; 431/12

[56] References Cited

U.S. PATENT DOCUMENTS

| | | | |
|---|---|---|---|
| 4,334,425 | 6/1982 | Crane | 73/112 |
| 4,362,499 | 12/1982 | Nethery | 431/12 |
| 4,375,950 | 3/1983 | Durley, III | 431/12 |
| 4,509,912 | 4/1985 | VanBerkum | 431/76 |
| 4,655,392 | 4/1987 | Wolfmüller | 236/15 E |
| 4,676,734 | 6/1987 | Foley | 431/12 |
| 4,685,072 | 8/1987 | Johnson et al. | 364/551.01 |
| 4,843,575 | 6/1989 | Crane | 364/550 |
| 4,953,390 | 9/1990 | Krempl et al. | 73/116 |

OTHER PUBLICATIONS

E. Levy, N. Sarunac, H. G. Grim, R. Leyse & J. Lamont, "Output/Loss: A New Method for Measuring Unit Heat Rate," Am. Soc. of Mech. Engrs., 87-JP-GC-Pwr-39 (Oct. 1987).

A. Ghamarian & A. B. Cambel, "Energy/Exergy Analysis of Fluidized Bed Combustor," Proc. Intersoc. Energy Conv. Eng. Conf. (Aug. 1982), pp. 323-327.

J. Szargut, "International Progress in Second Law Analysis," Energy, vol. 5 (1980), pp. 709-718.

A. Ghamarian & A. B. Cambel, "Exergy Analysis of Illinois No. 6 Coal," Energy, vol. 7, No. 6 (1982), pp. 483-488.

J. Szargut & T. Stryrylska, "Approximate Determination of the Exergy of Fuels," Brennstoff-Warme-Kraft, vol. 16, No. 12 (1964), pp. 589-596 (translation).

F. D. Lang, "Emmission Spectral Radiometer/Fuel Flow Instrument,": presented at Electric Power Research Institute's Workshop on Continuous Monitoring, Oct. 3, 1991.

*Primary Examiner*—Thomas G. Black
*Assistant Examiner*—Michael Zanelli
*Attorney, Agent, or Firm*—Howard E. Sandler; Stephen Donovan

[57] ABSTRACT

A method for determining fuel flow rate, pollutant flow rates, and boiler efficiency for a fossil-fired steam generator system from an analysis of the composition of the dry fuel base and composition of the combustion effluents.

20 Claims, 2 Drawing Sheets

METHOD FOR FUEL FLOW DETERMINATION AND IMPROVING THERMAL EFFICIENCY IN A FOSSIL-FIRED POWER PLANT

CROSS-REFERENCE TO RELATED APPLICATION

The present application is a continuation-in-part of application Ser. No. 07/450,686, filed Dec. 14, 1989, subsequently abandoned and continued as Ser. No. 07/905,157, filed Jun. 25, 1992, which in turn was abandoned and continued as Ser. No. 08/112,862, filed Aug. 25, 1993. The present application is related to the copending patent application for an Emission Spectral Radiometer/Fuel Flow Instrument filed Dec. 14, 1989, under Ser. No. 07/450,687, which was abandoned and refiled as a continuation on Jun. 29, 1992 as Ser. No. 07/908,525.

BACKGROUND OF THE INVENTION

1. Field of the Invention

The present invention relates to methods for determining fuel flow and improving thermal efficiency for fossil-fired steam generator systems via thermodynamics and more particularly to a method for monitoring the operation of such a system by analyzing the dry fuel chemical composition, the effluent $O_2$, and the principal composition of combustion effluents $CO_2$ and $H_2O$. In addition, the instrument measures the concentrations of the common pollutants produced from fossil combustion. These pollutants include: CO, $SO_2$, $SO_3$, NO, $NO_2$, $N_2O$, and hydrocarbons gases such as $CH_4$. Having computed the fuel flow rate, and knowing the fuel's chemical composition, the plant's effluent flow rates can then be determined.

The importance of accurately determining thermal efficiency is critical to the thermal performance monitoring of any fossil-fired steam generator system. If practical day-to-day improvements in efficiency are to be made, and/or corrections to thermally degraded equipment are to be found and corrections taken, then accuracy in determining thermal efficiency is an obvious necessity. The art of tracking the efficiency of a conventional power plant or any fossil-fired steam generator plant lies fundamentally in measuring the useful output and the total energy flow of the input fuel.

While the art of measuring the useful output of such a system is highly developed, measuring the total energy flow of the input fuel has traditionally caused significant problems. Measurement of the useful output of a conventional fossil-fired steam generator system can be either the steam flow produced or the subsequent electrical power generated via, commonly, steam expansion in turbines. Measurement of the energy flow of the input fuel requires knowledge of the heating value of the fuel and its mass flow rate.

The importance of accurately determining pollutant concentrations and their effluent flow rates is also critical to the practical operation of any fossil-fired steam generator system due to environmental constraints imposed through regulatory operational limitations, the potential of regulatory induced fines and concern by the owner of the facility for environmental protection.

2. Description of the Prior Art

Present industrial technique for measuring fuel flow, given uncalibrated devices, results in minimum variances of ±1.6% for gas and oil fuel flow measurements; and typically a minimum ±3.0% variance for coal fuel flow measurement given its bulk nature. It is not uncommon for a coal-fired system to find fuel flow variances over ±10% on any given day. It should also be noted that typical variances associated with measuring the flow of compressed water can vary typically between 0.5% to 2.0%; however, with proper calibration the variance can be reduced to ±0.25%. The measurement of fuel flow, indeed the measurement of any flow, has traditionally been accomplished via measurement of its mechanical effects on a device. Such effects include the pressure drop across nozzles or orifice plates, unique fluid densities, unit weighing of fuel handling conveyor belts (commonly used for coal fuel), speed of sound, nuclear resonance, change in bulk storage liquid levels, etc. Such fuel flow devices require careful calibration to achieve acceptable accuracy (acceptable accuracy for fuel flow, on a daily basis, is assumed to be less than ±1.0%).

A related technique, in philosophy, to the present invention has been developed by the Electric Power Research Institute at the Morgantown power plant. This technique is termed the "Output/Loss" Method. Refer to the technical paper by E. Levy, N. Sarunac, H. G. Grim, R. Leyse and J. Lamont, "Output/Loss: A New Method for Measuring Unit Heat Rate", Am. Society of Mech. Engrs., 87-JPGC-Pwr-39. This method produces boiler efficiency independent of fuel flow, if heating value and the working fluid's energy flow is known, unit thermal efficiency can be determined. The technique relies on measuring emission gas flow directly. Knowing emission gas flow allows the determination of the majority of the thermal losses associated with combustion, called "stack losses". However, it is not practical for most coal-fired units for the following reasons: 1) it does not address measurement of flue gas concentrations as the present invention (thus no updating of heating value, as accomplished by this invention, heating values can vary considerably from different mines and in their moisture contents); 2) the errors in gas flow measurements in irregular ducts can exceed ±20% resulting in ±2% error in boiler efficiency, and when combined with error in the working fluid's energy flow of at least ±1%, will result in at least ±3% error in unit efficiency; 3) the technique of direct flue gas flow measurements does not meet current U.S. Environmental Protection Agency's accuracy requirements of ±10%; and 4) the technique does not purport to determine emission flow rates since emission concentrations are not known through the technique which is an integral feature of the present invention.

In summary, inherent inaccuracies in direct fuel flow measurements which occur on a day-to-day basis for a gas or oil-fired plant, using present art with uncalibrated devices, are in the range of approximately 2% to 5%. For a coal-fired plant the variance in flow associated with direct measuring uncalibrated devices is typically 5% to 15% with a most likely variance of ±10%. With indirect fuel flow measurements using the Output/Loss Method, the variance in fuel flow is most likely no better than ±2%. It must be noted that for a coal-fired plant these ranges of accuracy are significantly wide to preclude trending of the monitored fuel flow rate for reasons of thermal efficiency or for detecting degraded equipment. However, at ±2% to ±10% variance the fuel flow rate is considered sufficiently accurate for gaseous emission flow determinations, but again, without knowledge of the effluent concentrations the individual effluent flow rates remain unknown.

Another important consideration is the variation in the fuel's heating value due to variations in fuel supplies and water content. Processes which address such variation in fuel heating value are discussed below.

The present invention solves the problems associated with measuring the energy flow of the input fuel whereby the fuel mass flow rate, the concentrations of common pollutants, the emission flow rates of the common pollutants, and the thermal efficiency of a fossil-fired steam generator system can be accurately determined.

SUMMARY OF THE INVENTION

The method of the present invention for determining fuel flow and for improving thermal efficiency of a fossil-fired steam generator system is performed by monitoring the operation of said system and making calculations which are derived from data obtained from the analysis of the composition of the dry fuel chemical composition and the composition of combustion effluents. The method comprises first analyzing the fuel for its dry base chemical composition, followed by the following concurrent steps of measuring the temperature of the effluents, the concentrations of $CO_2$ and $H_2O$ to an accuracy of at least $\pm 0.5\%$, the concentrations of the common pollutants to accuracies acceptable to regulatory authorities and $O_2$ with an accuracy at least comparable to zirconium oxide detection at the gas exit boundary of the thermal system in the exhaust of the combustion process; measuring the net energy deposition to the fluid being heated by the combustion process; calculating both the combustion efficiency based on the stoichiometric balance of the combustion equation and the boiler absorption efficiency based on determination of non-stack losses independent of the fuel flow rate; arithmetically combining combustion efficiency and boiler absorption efficiency to obtain calculated boiler efficiency as defined by the ASME Power Test Code 4.1; back-calculating fuel flow rate from the definition of boiler efficiency; and adjusting operation of the system to improve its thermal efficiency and/or to minimize the polluting emissions.

The method for determining fuel flow rate and boiler efficiency also includes the steps of repetitiously adjusting for assumed water concentration in the as-fired fuel until stoichiometric consistency is obtained between the measured $CO_2$ and $H_2O$ effluents and those determined from stoichiometrics based on the as-fired fuel. Although the composition of typical as-fired wet coal fuel is assumed in an iterative manner (given uncertain moisture content), any hydrocarbon fuel will produce unique relative concentrations of $CO_2$, $H_2O$ and $O_2$ as effluent.

The apparatus necessary for practicing the present invention includes utilization of a unique spectral radiometer for analyzing certain of the combustion effluents in stack gases. Use of the spectral radiometer disclosed concurrently herewith permits obtaining the required accuracy of measurements to make the backcalculation of fuel flow rate viable.

OBJECTS OF THE INVENTION

It is therefore an important object of the present invention to provide a method for determining the energy flow of the input fuel for a fossil-fired steam generator system without directly measuring the input mass flow rate of the fuel.

It is another object of the present invention to provide a method for determining the thermal efficiency for a fossil-fired steam generator system without directly measuring the input fuel mass flow rate.

It is a further object of the present invention to provide a means for determining the energy flow of the input fuel of a fossil-fired steam generator system by analyzing the composition of the input fuel for its dry base chemical composition and measuring the combustion effluents by means of an emissions spectral radiometer and then backcalculating the input fuel mass flow rate from the boiler efficiency equation, concurrently with this determination is the ability of the process to correct the fuel's heating value based on accurate emissions data.

And it is still another object of the present invention to provide a means for improving the efficiency of a fossil-fired steam generator system by accurately measuring the effluents in the exhaust of the combustion process with an emissions spectral radiometer.

And it is still another object of the present invention to provide a means for determining both the effluent concentrations and flow rates of common pollutants produced from a fossil-fired steam generator system by determining the fuel flow rate indirectly and having knowledge of the fuel's chemistry.

Other objects and advantages of the present invention will become apparent when the method and apparatus of the present invention are considered in conjunction with the accompanying drawings.

DESCRIPTION OF THE PREFERRED EMBODIMENT

Process Calculations

Figure 1:
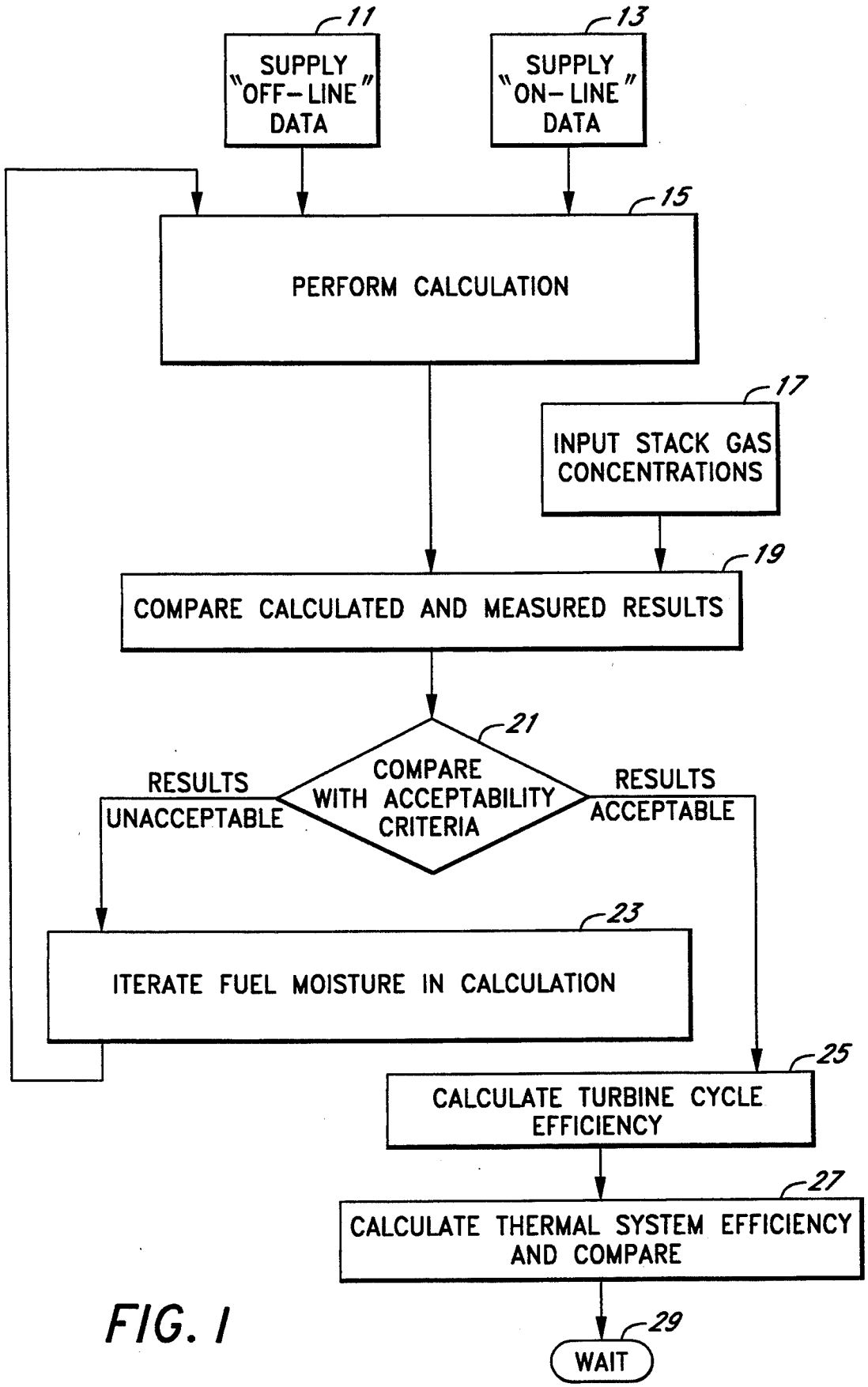
FIG. 1 is a block diagram illustrating the generic iterations for calculating fuel flow and system efficiencies.

The present invention is a unique process which determines the fuel mass flow rate into a conventional power plant or fossil-fired steam generator plant through thermodynamics; not through direct measurement of fuel flow. The approach relies on measurements of the fuel's heating value, the analysis of the effluent from such plants, and other unique data. Given the nature of such data, it all has the potential of high resolution on a continuous basis. The data can be input to a computer program for resolution of mass and energy balances associated with the system. Measured effluent include the concentration of combustion gases exiting the stack and the total energy deposition to the working fluid.

The thermal efficiency of a fossil-fired system is defined as:

$$\eta_{system} = \frac{\text{Useful Power Produced or Useful Energy Flow Delivered}}{\text{Energy Flow in Fuel} + \text{Boiler Energy Flow Credits}} \quad (1)$$

In a conventional power plant, the amount of electrical power produced appears in the numerator. In a steam generator, the net energy flow to the working fluid appears in the numerator (flow through the steam generator times the difference in outlet to inlet fluid enthalpy, kinetic energies, and potential energies). If dealing with a power plant, this equation is generally broken into two components: an efficiency related to the turbine cycle (involving the working fluid's ability to generate electricity), and an efficiency related to the boiler.

$$\eta_{system} = \eta_{boiler}\,\eta_{turbine\ cycle} \tag{2}$$

The definition of turbine cycle efficiency has been well defined. The variance in $\eta$turbine cycle is principally dependent on the measurement of working fluid flow rates. Such measurements are commonly accomplished via flow nozzles and/or orifice plates to within approximately ±1.0% on a routine basis, and, if properly calibrated, variances as low as ±0.25% are possible.

The generally accepted definition of overall boiler efficiency, and that used by the American Society of Mechanical Engineers, is as follows:

$$\eta_{boiler} = \frac{\text{Useful Energy Flow Delivered}}{\text{Energy Flow in Fuel} + \text{Boiler Energy Flow Credits}} \tag{3}$$

This definition is not helpful for continuous monitoring of thermal performance if the fuel flow cannot be measured accurately on a routine basis, which is typically the case for coal-fired plants. The "Energy Flow in Fuel" is of course the fuel's flow rate times its heating value. It can be used, however, to back-calculate fuel flow after the boiler efficiency, $\eta$boiler, has been determined (in this context the term $\eta$B is identical to $\eta$boiler). A separative effects procedure is applied to the formulation by calculationally excluding the fuel flow term. After excluding the flow term, three major deficiencies in the knowledge of a boiler's thermodynamic processes must still be addressed: (1) the complexities of the combustion process itself; (2) the specification of thermal losses not directly related to the combustion process (which could directly affect measured fuel flow); and (3) the complexities of heat transfer by convection and radiation in intricate geometries.

A computer program EX-FOSS TM has been developed to address these difficulties. It is a commercially available program which has been in use in the power generation industry since 1985 and is available from Exergetic Systems, Inc. of Point Richmond, Calif. EX-FOSS TM methodology separates the definition of boiler efficiency into components which, taken separately, calculationally exclude the first two of these problem areas. When separated, terms called combustion efficiency, $\eta$C, and boiler absorption efficiency, $\eta$A, are developed. The problem of describing the complexities of convection and radiation heat transfer is solved by calibrating internal correlations to actual test data, an internal feature of EX-FOSS TM.

Consider the following definitions:

$$\begin{aligned} BBTC &= \text{Useful Energy Flow Delivered from Boiler} \\ &= ERC - \Sigma(\text{Non-Stack Losses}) \\ &= ERC - m_{AF}HNSL \end{aligned}$$

$$\begin{aligned} ERC &= \text{Energy Released during Combustion} \\ &= (m_{AF}HHVP + m_{AF}HHBC) - \Sigma(\text{Stack Losses}) \\ &= (m_{AF}HHVP + m_{AF}HHBC) - m_{AF}HSL \end{aligned}$$

-continued $$= m_{AF}(HPR - HRX)$$

$m_{AF}$=As-Fired Fuel Flow Rate $m_{AF}$HHVP=Heat in Fuel (fuel flow x higher heating value)

$m_{AF}$HHBC=Boiler Credits (fuel flow x specific energy credits)

HPR=Enthalpy of the Combustion Products (includes the heat of formation plus $\int C_p dT$ at the stack)

HRX=Enthalpy of the Reactants (based on the heating value, sensible heating and energy credits)

HSL=Stack Losses (per unity fuel flow and as defined by: PTC 4.1: $L_G$, $L_{mF}$, $L_H$, $L_{mA}$, $L_X$, $L_z$, $L_{CO}$, $L_{UH}$ and $L_{UHC}$, all divided by $m_{AF}$)

HNSL=Non-Stack Boiler Losses (per unity fuel flow, relative to ERC, and defined by PTC 4.1: $L_B$, $L_P$, $L_d$, $L_r$ and $L_{UC}$, all divided by $m_{AF}$).

With these variable definitions, equivalent ways to express boiler efficiency include:

$$\eta_B = \frac{BBTC}{m_{AF}HHVP + m_{AF}HHBC} \tag{4}$$

$$\eta_B = \frac{(m_{AF}HHVP + m_{AF}HHBC) - \Sigma(\text{Stack Losses})}{m_{AF}HHVP + m_{AF}HHBC} \tag{5}$$

$$\eta_B = \frac{ERC - \Sigma(\text{Non-Stack Losses})}{m_{AF}HHVP + m_{AF}HHBC} \tag{6}$$

$$\eta_B = \frac{ERC}{m_{AF}HHVP + m_{AF}HHBC}\left[1.0 - \frac{\Sigma(\text{Non-Stack Losses})}{ERC}\right] \tag{7}$$

This last expression suggests that boiler efficiency can be divided into two separate efficiencies: one descriptive of the combustion process per se (called the combustion efficiency), and the other descriptive of certain non-stack losses (called the boiler absorption efficiency). As will be seen below, these non-stack losses describe items such as carbon contained in the refuse, pulverizer rejects, radiation loss, etc.

The combustion efficiency definition is suggested from efficiency as defined from the ASME Power Test Code 4.1 (PTC 4.1) In-Out Method: that is, net energy released at the boundary divided by the total energy input (the fuel's energy and system energy credits), but on a unity fuel flow basis:

$$\eta_C = 1.0 - \frac{\Sigma(\text{Stack Losses})}{m_{AF}HHVP + m_{AF}HHBC} \tag{8}$$

$$\eta_C = \frac{(m_{AF}HHVP + m_{AF}HHBC) - \Sigma(\text{Stack Losses})}{m_{AF}HHVP + m_{AF}HHBC} \tag{9}$$

$$\eta_C = \frac{ERC}{m_{AF}HHVP + m_{AF}HHBC} \tag{10}$$

$$\eta_C = \frac{m_{AF}(HPR - HRX)}{m_{AF}HHVP + m_{AF}HHBC} \tag{11}$$

$$\eta_C = \frac{HPR - HRX}{HHVP + HHBC} \tag{12}$$

In these expressions HPR is the enthalpy of the combustion products and HRX is the enthalpy of the reactants: $ERC = m_{AF}(HPR - HRX)$. It should be noted that the combustion efficiency is also composed of "losses," indeed the ERC term represents both stack losses and energy credit terms. The basis for the definition of boiler absorption efficiency comes from the PTC 4.1 Heat Loss Method when referencing non-stack energy terms. EX-FOSS TM uses both methods from PTC 4.1 in ways which accent the best features of each approach.

The boiler absorption efficiency is defined based on relative energy losses associated with non-stack quantities. It must be referenced to the Energy Released during Combustion term (ERC) if the individual loss terms are to be additive when calculating the total boiler efficiency:

$$\eta_A = 1.0 - \frac{\Sigma(\text{Non-Stack Losses})}{\eta_C(m_{AF}HHVP + m_{AF}HHBC)} \quad (13)$$

However the quantity $\eta_C(m_{AF}HHVP + m_{AF}HHBC)$ defines the ERC term, see definitions above, thus:

$$\eta_A = 1.0 - \frac{m_{AF}HNSL}{ERC} \quad (14)$$

$$\eta_A = 1.0 - \frac{HNSL}{HPR + HRX} \quad (15)$$

$$\eta_A = \frac{HPR - HRX - HNSL}{HPR + HRX} \quad (16)$$

This also affords a definition of non-stack boiler losses per unit fuel flow rate, HNSL, a specific energy term. The components of HNSL are numerically identical to definitions afforded by PTC 4.1 for non-stack Losses. From Eq.(15) HNSL is seen to be related to the Energy Released during Combustion term (ERC) reduced by the factor $(1.0 - \eta_A)$, given as:

$$HNSL = (HPR - HRX)(1.0 - \eta_A) \quad (17)$$

The following set of equations demonstrates that using the concepts of stack losses and non-stack boiler losses, as defined above (see Eq.(8) and Eq.(13)), the definition of boiler efficiency $\eta_B$ is readily developed:

$$\eta_B = \eta_C \eta_A \quad (18A)$$

$$\eta_B = \left[1.0 - \frac{\Sigma(\text{Stack Losses})}{(m_{AF}HHVP + m_{AF}HHBC)}\right] \left[1.0 - \frac{\Sigma(\text{Non-Stack Losses})}{\eta_C(m_{AF}HHVP + m_{AF}HHBC)}\right] \quad (18B)$$

$$\eta_B = 1.0 - \frac{HSL}{(HHVP + HHBC)} - \frac{HNSL}{\eta_C(HHVP + HHBC)} + \frac{HSL\ HNSL}{\eta_C(HHVP + HHBC)^2} \quad (18C)$$

$$\eta_B = 1.0 - \frac{HSL}{(HHVP + HHBC)} - \frac{HNSL}{\eta_C(HHVP + HHBC)}[1.0 - HSL/(HHVP + HHBC)] \quad (18D)$$

-continued $$\eta_B = 1.0 - \frac{HSL}{(HHVP + HHBC)} - \frac{HNSL}{(HHVP + HHBC)} \quad (18E)$$

$$\eta_B = 1.0 - \frac{\Sigma(\text{Total Boiler Losses})}{(m_{AF}HHVP + m_{AF}HHBC)} \quad (18F)$$

It should be noted that the quantity HSL includes the following PTC 4.1 terms relating stack losses to as-fired fuel flow rate:

$$m_{AF}HSL = L_G + L_{mF} + L_H + L_{mA} + L_X + L_Z + L_{CO} + L_{UH} + L_{UHC} \quad (19)$$

The quantity HNSL includes the following PTC 4.1 terms relating non-stack losses to as-fired fuel flow rate:

$$m_{AF}HNSL = L_B + L_p + L_d + L_r + L_{UC} \quad (20)$$

The combination of the combustion efficiency and boiler absorption efficiency is the (PTC 4.1 defined) overall boiler efficiency. The following, using direct energy flow terms, as opposed to using the system loss terms of Eq.(18), again demonstrates the derivation of boiler efficiency (see Eq.(12) and Eq.(16)):

$$\eta_B = \eta_C \eta_A \quad (21A)$$

$$\eta_B = \frac{HPR - HRX}{HHVP + HHBC} \cdot \frac{HPR - HRX - HNSL}{HPR - HRX} \quad (21B)$$

$$\eta_B = \frac{HPR - HRX - HNSL}{HHVP + HHBC} \quad (21C)$$

$$\eta_B = \frac{BBTC}{m_{AF}(HHVP + HHBC)} \quad (21D)$$

Equation (21D) may be solved for the fuel flow rate:

$$m_{AF} = \frac{BBTC}{\eta_B(HHVP + HHBC)} \quad (21E)$$

$$m_{AF} = \frac{BBTC}{\eta_B(HHVP + HHBC)} \quad (21E)$$

By separating boiler efficiency into combustion and boiler absorption components, the analyst has knowledge as to where degradations are occurring. If combustion efficiency decreases (stack losses increase), the plant engineer would consider: fuel-air mixing equipment, differences in fuel flow entering various parts of the boiler, low heat content in the fuel, etc.—all sources directly affecting the combustion process (i.e., stack losses). The terms comprising combustion efficiency can be easily reduced to a unit basis of as-fired fuel, refer to Eq.(12); as such these terms have the potential to be determined with great accuracy. HHVP is the corrected higher heating value, HHBC is the boiler's energy credit per unit fuel flow, HPR and HRX are the energy of products and reactants based on accurate properties, consistent properties and HHVP.

In a similar manner, if the boiler absorption efficiency decreases (non-stack boiler losses increase), consideration should be given to terms affecting this efficiency: radiation & convection losses, heat content in the coal rejects, heat exchanger water/steam leaks, heat exchanger effectiveness, etc. The boiler absorption efficiency also has the potential to be determined with high accuracy. As a minimum, this term is generally a large number (approaching unity) thus its error is no greater than its compliment (if $\eta_A = 98\%$, its maximum error is $\pm 2\%$). Although $\eta_A$ is dependent (through the term ERC) on $\eta_C$, and a given degradation in $\eta_C$ will affect $\eta_A$, the impact on relative changes is generally small. Also, by iteration technique, $\eta_A$ can be resolved without a priori knowledge of fuel flow rate. Thus, both $\eta_C$ and $\eta_A$, therefore $\eta_B$, can be determined independent of fuel flow.

The enthalpy of the products (HPR) can be accurately calculated using thermodynamic properties:

$$HPR = \Sigma n_i h_{PROD\text{-}i}/(xN_{AF}) \quad (22)$$

$$h_{PROD\text{-}i} = H_{fi} + H_{fg} + h_{Ti} - h_{Ref} \quad (23)$$

where:

$n_i$=Molar quantity of i per 100 moles of dry gas effluent x=Moles of as-fired fuel per 100 moles of dry gas effluent $N_{AF}$=Molecular weight of as-fired fuel $H_{fi}$=Heat of formation of i $H_{fg}$=Latent heat of water $h_{Ti}$=Enthalpy at the stack, at temperature T $h_{Ref}$=Enthalpy at the calorimetric temperature (77F)

Note that $h_{Ti} - h_{Ref\text{-}i} = \int C_p dT$, evaluated from a reference temperature to the stack exit temperature.

The energy content of the reactants is determined by using the fundamental definition of heat value, as it is related to the difference between ideal products of combustion and the actual enthalpy of reactants at the calorimetric temperature.

$$\int \delta Q = -HHVP \quad (24)$$
$$= HPR_{Ideal} - HRX_{Ref} \quad (25)$$

This equation is used to solve for $HRX_{Ref}$ which is then corrected for system effects. These effects, in the order presented in Eq.(26), include: the energy of combustion air; in-leakage of water/steam; the sensible energy in the as-fired fuel; boiler credits associated with out-of-envelope sources (defined by PTC 4.1); and the chemical energy contained in reactant water found in the air's moisture ($b_A$) and boiler in-leakage ($b_Z$).

$$HRX = HRX_{Ref} + h_A + h_Z + h_F + (B_X + B_W - L_W + B_{Fan})/m_{AF} + b_A(1.0 + \beta)N_{H2O}(H_f - {}_{H2O} + H_{fg})/(xN_{AF}) + b_Z N_{H2O}(H_f - {}_{H2O} + H_{fg})/(xN_{AF}) \quad (26)$$

Ideal products from any hydrocarbon fuel comprise $CO_2$, $H_2O$ and $SO_2$. Thus, if the heating value is measured with care, the enthalpy of the reactants at the calorimetric temperature can be determined with accuracy:

$$HRX_{Ref} = HHVP + HPR_{Ideal} \quad (27)$$

$$HRX_{Ref} = HHVP + H_{f-CO2}(\alpha_0 TR + \alpha_4 + \alpha_7 + \alpha_8)/N_{AF} + H_{f-H2O}(\alpha_0 ZR + 2\alpha_2 + 2\alpha_5 + 2\alpha_9)/2N_{AF} + H_{f-SO2}(\alpha_6 + \alpha_9)/N_{AF} \quad (28)$$

Thus, the substitution of Eq. (28) into Eq. (26) allows the determination of HRX for the actual "as-fired" conditions. The molar quantities described by $\alpha_i$ relate to the fuel's constituents and are defined below; as used in Eq. (28) they describe the ideal moles of product given complete combustion. The $\beta$ term used in Eq.(26), etc., relates to air heater leakage from combustion air into the gas path (flue), and is defined such that $\beta$ moles of air leakage cross the boundary per one mole of true combustion air. Environmentally sensitive terms are defined as $h_A$ (the enthalpy of the combustion air and its moisture), $h_Z$ (the energy of all boiler in-leakage of water/ steam), and $h_F$ (the fuel's sensible heat). Other terms in Eq.(26) describe energy credits to the system. In total, these quantities correct the HRX term from the calorimetric temperature (77 F.) to the actual inlet conditions of the as-fired fuel, account stoichiometrically for all water/steam inputs (combustion air and leakages), and account for system energy credits. In-leakage of water and air cause problems but are accommodated by the EX-FOSS TM program.

The basic stoichiometric equation relating reactants to products is presented as Eq. (29). The quantities comprising the combustion equation are traditionally based on an assumed 100 moles of dry gaseous product. This assumption is useful when measuring stack emissions since the commonly measured volume fractions are based on dry molar fractions. The combustion equation used in EX-FOSS TM is truly a "systems" equation describing boundary stoichiometrics:

$$x[\alpha_0(C_{YR}H_{ZR}) + \alpha_1(N_2) + \alpha_2(H_2O) + \alpha_3(O_2) + \alpha_4(C) + \alpha_5(H_2) + \alpha_6(S) + \alpha_7(CO_2) + \alpha_8(CO) + \alpha_9(H_2S) + \alpha_{10}(ash)] + [a(O_2) + \phi_{Ref}a(N_2) + b_A(H_2O)][1.0 + \beta] + b_Z(H_2O) = d(CO_2) + e(CO) + f(H_2) + g(O_2) + h(N_2) + j(H_2O) + x\alpha_{10}(ash) + k(SO_2) + l(SO_2) + m(NO) + p(N_2O) + q(NO_2) + t(C_{YP1}H_{ZP1}) + u(C_{YP2}H_{ZP2}) + v(C_{Refuse}) + w(C_{Reject}) + a\beta(O_2) + \phi_{Ref}a\beta(N_2) + b_A\beta(H_2O) \quad (29)$$

The following defines nomenclature used in Eq. (29). Note that all are molar quantities.

x=As-fired fuel per 100 moles of dry gas product $\alpha_i$=Fuel constituents per unity moles of as-fired fuel, $\Sigma\alpha_i = 1.00$ $a + \phi_{Ref}a$=Dry combustion air without air heater leakage $a\beta + \phi_{Ref}a\beta$=Dry air from air heater leakage present in flue $b_A$=Moisture in the entering combustion air $b_A\beta$=Moisture from air heater leakage present in flue $b_Z$ =Water/steam in-leakage from the working fluid $n_i$=Molar quantities of dry flue gas related to specific compounds: d, e, f, g, h, k, 1, m, p, q, t and u; the sum denoted as $\Sigma n_i$. For example, "f" is the moles of $H_2$ in the flue gas per 100 moles of dry gas product, "t" is the moles of unburned hydrocarbon (#1) per 100 moles of dry gas, etc.

$n_{ii}$=Molar quantities of non-gas product compounds: j, $x\alpha_{10}$, v, w, $b_A\beta$; the sum denoted as $\Sigma n_{ii}$.

$\beta$=Air leakage factor, a molar ratio $\phi_{Ref}$=Ratio of nitrogen to oxygen in combustion air.

Resolution of Eq. (29) proceeds in typical fashion, solving for all $n_i$ and $n_{ii}$ quantities. At least two cases are always analyzed by EX-FOSS TM: an "actual" case (using the unaltered input data), and an "error" analysis case which produces a consistency check on the input stack gas concentrations (in essence an error on $\eta_C$). Results from the error analysis are used for convergence checks for the combustion efficiency iterations. The importance and functionality of Eq.(29) to the process of determining fuel flow and system efficiencies lies in the fact that total consistency of a molar (thus mass) balance is inherent in its formulation.

In summary the aforementioned technique describes the process of calculating boiler efficiency based on effluent measurement data, fuel heating value and several parameters of minor importance. The next stage of the process involves the recognition that a given fuel has an unique chemical composition, thus when burned will yield unique stoichiometrics in its gaseous effluent. The principal volume of combustion gaseous effluent consists of $N_2$, $CO_2$, $H_2O$ and $O_2$. $H_2O$, when effluent from a commercial steam generator, is in its superheated phase thus acting as a gas (when stack gas is measured it is typically cooled before analyzed, when cooled the water is condensed thus the $CO_2$ and $O_2$ gases are measured on a dry bases). The source of $N_2$ is principally from the air used to burn the fuel and it has little chemical reactiveness, thus its sensitivity to the fuel's chemical composition is not significant. However, the relative concentrations of carbon and hydrogen found in any fossil fuel will have significant impact on the relative concentrations of $CO_2$ and $H_2O$ found in the effluent, as coupled to the relative quantities of free $O_2$ used to burn the fuel. This implies that the molar fractions of $CO_2$, $H_2O$ and $O_2$ present in the effluent (the boiler's stack) must be unique relative to the fuel input and supplied combustion air streams. Gas and oil are hydrocarbon fuels, and thus contain significant quantities of both carbon and hydrogen, which are bound chemically. Coal also contains carbon and hydrogen bound mechanically and chemically, and also quantities of free water (ranging from 2 to 45 percent by weight). Water is found naturally in coal, and although the coal can be dried, it is not practical to totally remove the moisture. Thus for any fossil-fired plant, if accurate measurements are made of the $CO_2$, $H_2O$ and $O_2$ effluent, then not only can the $\eta_C$ term be calculated accurately, but inherent consistency checks are afforded through stoichiometric considerations involving carbon, hydrogen and oxygen balances.

It should also be pointed out that if a coal-fired plant uses coal from several mines (or otherwise having different or changing chemical makeups), the dry analysis of the fuel can be difficult to obtain with high accuracy on a routine basis. This general technique can obviously be used to confirm changes in the coal's chemical makeup and under certain conditions can be used to back-calculate the carbon to hydrogen ratio in the fuel. In its simplest form the process can rely on a priori knowledge of the fuel's dry chemical analysis, if the dry analysis is relatively constant this assumption is quite adequate. However, the process of the present invention can also alter the as-fired fuel heating value based on high accuracy $CO_2$ and $H_2O$ measurements in the effluent. For the calculational process discussed herein, the heating value is input on a dry basis; the calculational process iterates on the water content in the incoming fuel until the measured stack $H_2O$ agrees with the stoichiometrically determined value. Using basic stoichiometric relationships coupled with high accuracy effluent measurements, the carbon to hydrogen ratio can be determined. With this ratio, on-line variations to a reference heating value can be determined through normalization. The normalization involves use of a correlation relating carbon, hydrogen, oxygen and sulfur contents to a dry-base heating value then correcting for water. This correlation is taken from the work of Ghamarian & Cambel and is based on the well known work of Szargut and Szargut & Stryrylska. The references include: A. Ghamarian & A. B. Cambel, "Energy/Exergy Analysis of Fluidized Bed Combustor". Proceedings of the Intersociety Energy Conversion Engineering Conference, Aug. 8–12, 1982, pp. 323–327; A. Ghamarian & A. B. Cambel, "Exergy Analysis of Illinois No. 6 Coal", Energy, Vol. 7, No. 6, 1982, pp. 483–488; J. Szargut, "International Progress in Second Law Analysis", Energy, Vol. 5, 1980, pp. 709–718; and J. Szargut & T. Stryrylska, "Approximate Determination of the Exergy of Fuels", Brennstoff-Warme-kraft, Vol. 16, No. 12, December 1964, pp. 589–596. The correlation is accurate to within ±0.7% ΔHHV deviation for over four dozen short- and long-chained hydrocarbon compounds. For coal, demonstrated below, having a low oxygen content the correlation's accuracy is estimated at ±0.5%. A similar correlation exists for fuel with high oxygen content. The method of this process calculates a term $\Delta HHV_{ref}$ based on a reference dry-based heating value of nominal fuel, using known concentrations of carbon, hydrogen, oxygen and sulfur. With the term $\Delta HHV_{ref}$ and Eq. (31) or Eq. (32), the on-line heating value is then computed via Eq. (33) based on continuously updated concentrations of carbon, based on accurate effluent measurements. Oxygen and sulfur, given their small molar concentrations, can be assumed constant. The following equations are normalized to dry fuel data, as required input to the FUEL program (used to prepare EX-FOSS input); the term $N_{AF}$ is the molecular weight of the as-fired (wet-based) fuel as determined automatically by EX-FOSS TM.

$$\Delta HHV_{ref}=HHV_{ref/dry}-(-178387.18\alpha_3+183591.92\alpha_4+78143.68\alpha_5\ 127691.99\alpha_6-\alpha_5N_{H20}\Delta h_{fg})_{ref}/(N_{AF}-\alpha_2N_{H20})_{ref} \quad (30)$$

$$LHV_{on\text{-}line/dry}=(-178387.18\alpha_3+183591.92\alpha_4+78143.68\alpha_5+127691.99\alpha_6)/(N_{AF}-\alpha_2N_{H20}) \quad (31)$$

If the power station has measured dry heating values from different mines, un-mixed, then a specific correlation for the dry lower heating value can be established as a function of carbon, hydrogen, oxygen and sulfur concentrations. This process is recommended only if the resulting standard deviation is less than ±0.5%. Such a correlation can be written in the following form, where the $C_i$ constants are determined by fitting routines:

$$LHV_{on\text{-}line/dry}=(C_3\alpha_3+C_4\alpha_4+C_5\alpha_5+C_6\alpha_6)/(N_{Af}-\alpha_2N_{H2O}) \quad (32)$$

The as-fired heating value (i.e., a total wet-base) is given by:

$$HHV_{AF}=(LHV_{online/dry}+\Delta HHV_{ref})(N_{AF}-\alpha N_{H2O})/N_{AF}+(\alpha_2+\alpha_5)N_{H2O}\Delta h_{fg}/N_{AF} \quad (33)$$

where the water content term, $\alpha_2$, is iterated until convergence is achieved. The various terms comprising these equations, if not evaluated with precision, can lead to error in the calculated heating value and fuel flow rate. Note however that the sign of the error introduced by the heating value, HHV, will always have an opposite change in the calculated fuel flow, $m_{AF}$, given a set energy flow to the working fluid. The net effect on the boiler's energy flow, $m_{AF}$HHV, is of course diminished—errors will always offset. This process results in a factor of five dilution effect. For example, consider that +0.52% change in HHV will affect fuel flow by −0.61%, but boiler efficiency and thus gross unit heat rate by only +0.12% ΔHR. When defining boiler efficiency, $\eta_B$, the HHV term is used in developing the enthalpy of reactants, within the numerator term HRX of Eq. (12); it also appears in $\eta_B$'s denominator, see Eqs. (18) and (21C).

In summary, details of the procedure involve, principally, the measurement of electrical power produced or net energy flow to the working fluid, boiler's stack temperature, the fuel's chemical composition without water (i.e., dry basis), the fuel's heating value on a dry basis, and $CO_2$, $H_2O$ and $O_2$ concentrations in the stack (i.e., the boiler's combustion effluent). The $CO_2$ and $H_2O$ concentrations are not input into the EX-FOSS TM program, they are computed based on stoichiometrics. However the stack $O_2$ concentration, concentration of the common pollutants form ESR/FF measurements and other minor data, is supplied input. Using EX-FOSS TM in an iterative manner with this basic input data, complete stoichiometrics are computed including $CO_2$ and $H_2O$. The computed quantities of $CO_2$ and $H_2O$ are then compared to the measured, if they agree then stoichiometric consistency is had and boiler efficiency is computed correctly. If the $CO_2$ and $H_2O$ concentrations do not agree, and little or no water is present in the fuel (i.e., using a gas or oil fuel), and no water is present from boiler in-leakage, then measurement errors must be present. For gas or oil fuel the situation of inconsistent calculations is unusual for chemical analysis of fuel is usually highly accurate obtained on a routine basis, and assuming the $CO_2$ and $H_2O$ measurements are accurate, the fault will generally lie with the $O_2$ stack measurement. If the $CO_c$ and $H_2O$ concentrations do not agree, and water is present in the fuel or present from boiler in-leakage, then the concentration of water as an input to the boiler is varied until agreement is reached. This latter scenario is obviously applicable to a coal-fired plant; it does require that the measurement of stack $CO_2$, $H_2O$ and $O_2$ be maintained to high precision.

In summary, by mass and energy balances based on unity fuel flow rate, by using highly accurate thermodynamic properties of combustion gases, by knowing the net energy flow supplied to the working fluid from the boiler, and by recognizing the integral relationship of effluent $CO_2$, $H_2O$ and $O_2$ to the chemical composition of input fuel, fuel flow to the boiler can be computed. Knowing fuel flow allows routine tracking of a fossil-fired plants' overall thermal efficiency, thus continuous correction of problems impacting thermal efficiency is possible.

By knowing the fuel flow rate and the complete stoichiometric relationships, fuel chemistry to combustion effluents as resolved by EX-FOSS, calculating individual emission flow rates, $m_{species\text{-}i}$ (1 bm/hr), can occur as follows:

$$m_{species\text{-}i} = m_{AF}\Phi_i N_i/(XN_{AF}) \quad (34)$$

where Φ is the molar fraction of an effluent species on a dry-basis, $m_{AF}$ is the computed as-fired fuel flow rate, x is the molar quantity of as-fired fuel per stoichiometric dry-base and $N_i$ & $N_{AF}$ are molecular weights of the species, i, and the as-fired fuel. The terms $\phi_i$ derive directly from solution of the right-hand terms of Equation (29) as discussed above, for example $\Phi_{SO2}$ = k. The emission rate per species, in units of 1 bm per million Btu of fuel energy input, termed $ER_i$, is given by the following:

$$ER_i = 10^6 m_{species-i}/(m_{AF}HHV) \quad (35A)$$
$$= 10^6 \Phi_i N_i/(xN_{AF}HHV) \quad (35B)$$

Note that the emissions rate can be evaluated independently of the as-fired fuel flow rate. However, the computational accuracy of the fuel flow rate, as determined using the processes of this invention, intrinsically affects the emissions rate through Φ, x and $N_{AF}$.

THE APPARATUS

The success of the described process is strongly dependent on highly accurate measurements of fuel chemical composition, effluent data, stack temperature, and heating value. Other minor parameters routinely used are also required (for example, boiler energy credits, combustion air conditions, etc.). All of this data can be measured with present technology and with sufficient accuracy commonly practiced by fossil-fired plant owners and their vendors, with the exception of $CO_2$ and $H_2O$ stack gas concentrations. Present technology as practiced at power plants and at steam generation plants employs instruments which typically have accuracy for $CO_2$ and $H_2O$ measurements no better than ±5%. To date there has been little need to measure these compounds with great accuracy, but to perform the process of the present invention, highly accurate measurements of these constituents are required.

To assure that the process of the invention is functional, the Emissions Spectral Radiometer/Fuel Flow (ESR/FF) analyzer was created. This instrument reduces the variance over that possible from present power plant instrumentation by at least an order of magnitude, thus assuring accurate measurements for the calculation. The ESR/FF analyzer measures the absorption spectrum from 1300 nano-meters to over 5500 nano-meters wave-length. Species which most strongly absorb in this spectrum include $CO_2$ and $H_2O$. The common pollutants produced from fossil combustion also absorb within this region. Measuring over this spectral range allows the calculation of atom densities associated with hundreds of absorption lines. Common practice in power plants and steam generation plants is to measure a single narrow-band absorption. Additionally the ESR/FF analyzer employs statistical analysis of the measured absorption spectra, greatly reducing normal instrumentation noise.

The ESR/FF instrument operates on the measurement of spectral absorption patterns continuously from the near visible to the far infra-red. These measurements are referenced to an unabsorbed, near perfect, black body source of radiation which is provided to radiate through the stack gases. A portion of this radiation is absorbed by the gases at unique wave lengths: the remaining radiation is detected by a circular variable optical filter (CVF). The present art employs a CVF; however, a diffraction grating could also be employed. Using a CVF or diffraction grating allows the detection of essentially continuous spectral absorption. The compounds of principal interest include $H_2O$ and $CO_2$ which can be measured by the ESR/FF analyzer with a resolution of ±0.5%. In addition, the common pollutants of CO, $SO_2$, $SO_3$, NO, $NO_2$, $N_2O$, and hydrocarbons such as $CH_4$ can be detected. The advantage of measuring continuous spectral absorption patterns lies in the potential of analyzing many hundreds of narrow band absorptions for the various compounds—present power plant technology will typically measure one or two narrow bands for only $CO_2$ and CO. Given that hundreds of absorption patterns result, computers are used to apply statistical analysis to produce exact determinations of the compounds' concentrations.

By knowing the stack emission of $CO_2$ and $H_2O$ very accurately combined with accurate measurement of $O_2$ by zirconium oxide detection or other means and known energy flow delivered to the working fluid from the boiler (typically the final feedwater conditions, throttle conditions, and cold and hot reheat conditions), an accurate determination can be made of a power plant's fuel flow using the EX-FOSS TM program. For coal fired plants, such determination of fuel flow is critical to understand "instantaneous" efficiency.

Present accuracy of simple IR absorption systems using a few narrow bandpass filters is typically ±5% accuracy, with routine measurements at ±10% in heavily sooted stacks. The ESR/FF instrument is routinely accurate to within ±0.5% for $CO_2$ and $H_2O$, and generally within ±10 ppm-volume for the common pollutants. The burden of accurate fuel flow lies with measurement of energy flow to the working fluid. This implies (for a modern power plant) accurate knowledge of feedwater conditions, turbine inlet conditions, feedwater flow rate, and making accurate mass/energy balances across the boiler's reheater. Sensitivity studies employing the methods of this patent, using typical parameters found in a coal-fired power plant indicate a ≈±0.75% variance in fuel flow with a ≈±0.50% variance in heating value, resulting in less than ±1.50% variance in plant efficiency when assuming a ±1.00% variance in energy flow to the working fluid, the BBTC term of Equation (4). Refer to the technical paper by F. D. Lang, "Emission Spectral Radiometer/Fuel Flow Instrument", presented at the Electric Power Research Institute's Workshop on Continuous Emission Monitoring, Atlanta, Ga., Oct. 2-3, 1991.

THE DRAWINGS

Two diagrams of the calculational process are presented. FIG. 1 illustrates the process from a generic point of view, emphasizing the fundamentals of the process such as internal iterations within the EX-FOSS TM computer program. FIG. 1 illustrates the generic process used to calculate fuel flow and system efficiencies based on accurately knowing a boiler's effluent. The EX-FOSS TM program is a large computer program designed to run on an Intel-based personal computer. It is supplied certain data described in FIG. 1; both "off-line data," box 11, which does not vary routinely and "on-line data," box 13, which does vary with operational conditions. The calculational process is performed within the "EX-FOSS.EXE" box 15. As explained earlier, EX-FOSS TM requires the input of boundary conditions (working fluid energy flows produced by burning fuel, gaseous effluent, stack temperature, etc.). In addition, the process requires the accurate input, for comparison reasons, of $CO_2$, $H_2O$ and common pollutant emission concentrations from the ESR/FF analyzer, box 17. The principal results of the process are calculated fuel flows, thus pollutant flow rates, and system efficiencies.

Box 11 represents off-line data which includes: program set up; heat transfer set up; tube leakage input; non-stack losses; air preheater leakage; and minor inputs. Box 13 represents on-line (routine) data which includes: fuel analysis; measured stack $O_2$; combustion air conditions; reheat conditions (flow, pressures, and temperatures); feedwater conditions (flow, pressure, and temperature); and throttle conditions (flow, pressure, and temperature). These data are input to the EX-FOSS.EXE, box 15.

The EX-FOSS.EXE program represented by box 15 has numerous steps as follows:

15.01—Initialize the program;

15.02—Estimate a stack $CO_2$ concentration based on complete combustion with the given stack

15.03—Calculate a complete set of effluent molar concentrations (stack $O_2$ is fixed by input). This includes the calculated stack $H_2O$ as based on combustion $O_2$, hydrogen in the fuel as bound in hydrocarbon and hydrogen compounds and free $H_2$, moisture in the combustion air, in-leakage of water, $H_2$ present in the stack and hydrogen bound in unburned hydrocarbons compounds present in the stack;

15.04—Calculate the error in $\eta_C$ based on consistent stoichiometrics and knowing the $N_2$ and $O_2$ ratio of combustion air;

15.05—Estimate a new $CO_2$ concentration if the error in $\eta_C$ is not acceptable;

15.06—If the calculational result yields an unacceptable error, then iterate back through set 15.03;

15.07—If the calculation yields an acceptable error in the $\eta_C$, continue the process;

15.08—Calculate Non-Stack Losses via Eq.(20). see PTC 4.1 for methods used for "L" terms; estimate as fired fuel flow rate for the first iteration;

15.09—Calculate $\eta_A$ via Eq. (15);

15.10—Calculate all terms required for $\eta_C$, and calculate $\eta_C$ via Eq. (12);

15.11—Calculate $\eta_B$ via Eq. (18A);

15.12—Calculate total energy flow from the boiler to the working fluid: $\Sigma(mh_{outlet}-mh_{inlet})$;

15.13—Calculate the as-fired fuel flow rate, $m_{AF}$, via Eq. (21D). Iterate on fuel flow rate until $\eta_A$ is converged;

15.14—Present results and exit program.

Concurrently with the calculations the ESR/FF analyzer makes high accuracy measurements of the $CO_2$ and $H_2O$, box 17. These measurements are then compared in box 19 with the calculated $CO_2$ and $H_2O$ concentrations.

The differences between the measured and the calculated $CO_2$ and $H_2O$ concentrations are then compared for acceptability, box 21. If the results are unacceptable then a further consideration is made, box 23, whereby if the fuel is a gas or oil fired plant without water in the fuel or in-leakage, the accuracy of the measured data should be questioned (given accurate data, calculations closure must occur if the only water is chemically bound in the fuel). If it is a coal-fired plant and accurate base data is obtained, then iterate on fuel moisture back through EX-FOSS in box 15. If the results of the comparison made in box 21 are acceptable, then calculate turbine cycle efficiency, if applicable, box 25. Then calculate the thermal system efficiency via Eq. (2) and compare the fuel flow rate to the measured as applicable, box 27. If the computed efficiency of the system is degraded from a norm, then the operation of the system is adjusted to improve the thermal efficiency by means of the suggested remedies described after Eq. (21D) disclosed earlier herein. If the efficiency proves acceptable, then the program is simply held in advance until it is needed to be run over again to make a further check on the efficiency of the system.

Figure 2:
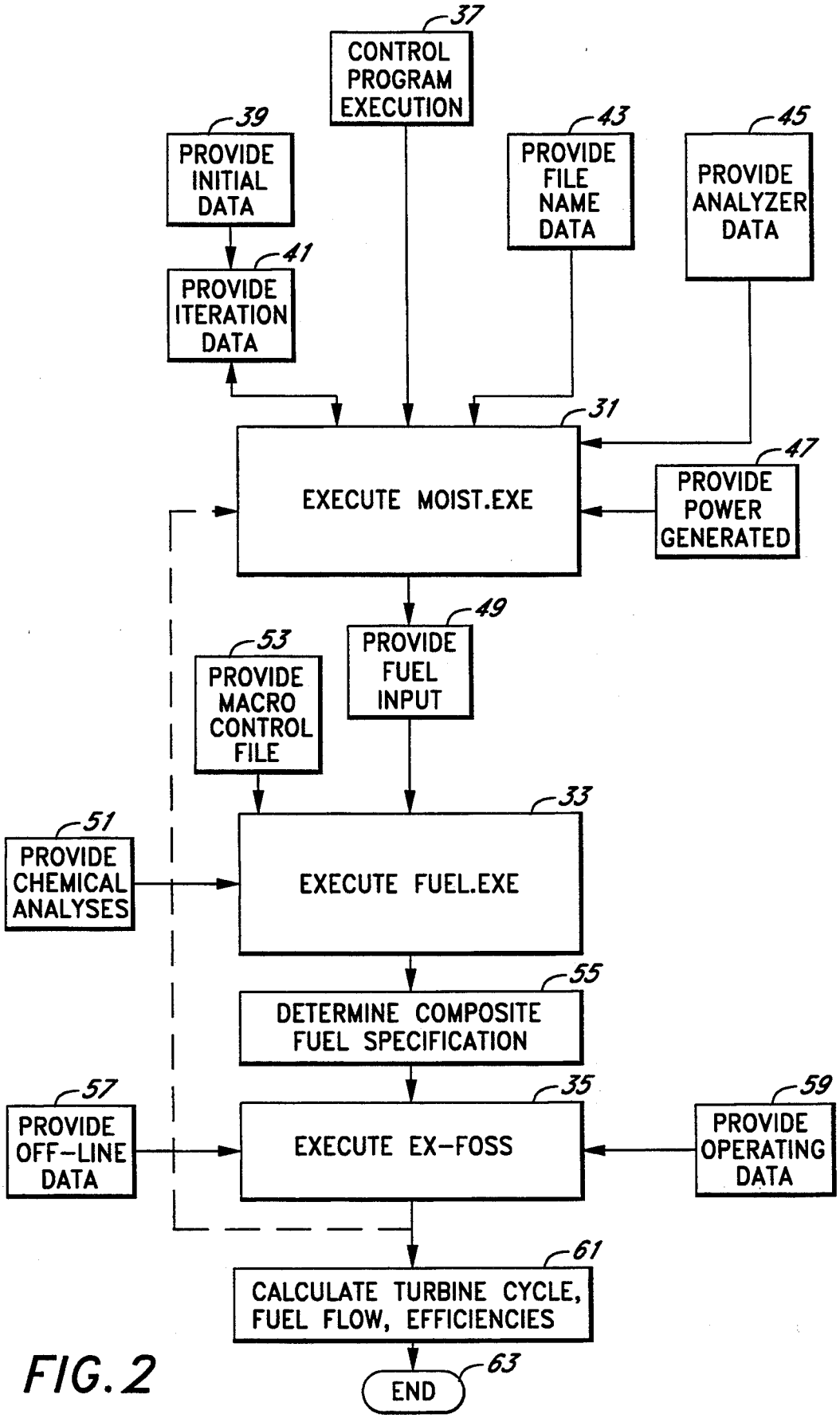
FIG. 2 is a block diagram showing the detailed fuel flow and system efficiency calculational process for a coal-fired plant.

FIG. 2 describes the calculational process for a coal-fired plant, emphasizing the method of iterating on the concentration of water as input to the system, to determine fuel flow and system efficiency by means of a unique fuel flow and system energy calculational procedure. Three principal computer programs are employed: MOIST.EXE, box 31, FUEL.EXE, box 33, and EX-FOSS TM, box 35. The execution of these routines is governed by generic commands contained in the GROSSi.BAT file, box 37, which is the MACRO control file.

The function of MOIST.EXE is to prepare input data for the FUEL.EXE program. Input to MOIST.EXE includes file-naming data contained in the files ITERO.-DAT, box 39, which is initial data; ITER.DAT, box 41, which is iteration data; and MiFILES.DAT, box 43, which is file name data. Results from the ESR/FF analyzer, box 45, are also input to MOIST.EXE which are high accuracy measurements of $CO_2$ and $H_2O$. Also input are, box 47, plant electrical power generated (or net energy flow produced to the working fluid if a non-electric steam system), known fuel flow data associated with minor stabilizing gas or oil fuel if applicable (natural gas is many times used to stabilize the burning of coal), and the initial guess of the fuel's water fraction.

Output from MOIST.EXE consists of the file Mi-MAPS.FUL, box 49, which is the fuel input file or the principal input data for FUEL.EXE, box 33. Input to FUEL.EXE, box 51, also comprises the off-line data including the program set up, the specification of the dry chemical analysis of the coal, and the chemical analysis of any stabilizing fuel. Also input is Mi-MAPS.-DAT, box 53, the MACRO control file.

FUEL.EXE computes, using either molar or weight fractions, the composite as-fired fuel composition, and calculates the heating value of the composite fuel. Its output consists of a modified EX-FOSS TM input data file which contains the composite fuel specification, box 55.

The EX-FOSS.EXE program is described in FIG. 1 and resolves all thermodynamics associated with the boiler. The input includes Mi-MAP.INP, box 55, the boiler simulation input file, and the off-line data, box 57, including: program set up; heat transfer set up; tube leakage if applicable; non-stack losses; and minor parameters of the system. The input also comprises the on-line routine data, box 59, including: stack temperature; wet and dry bulb temperatures of combustion air; reheat conditions, if applicable (flow, pressure, and temperature); feedwater conditions inlet to the boiler (flow, pressure, and temperature); throttle conditions outlet from boiler (flow, pressure, and temperature); and measured stack $O_2$. The results of the EX-FOSS-.EXE calculations, box 35, are iterated back through the MOIST.EXE program, box 31, until converged. Then the turbine cycle, fuel flow, and system efficiencies are calculated, box 61. If the computed system efficiency is degraded from a norm, operation of the system is adjusted to improve the thermal efficiency, box 63.

Thus, it will be seen from the description of the preferred embodiment that all of the objects and advantages of the invention are achieved. While the preferred embodiment of the invention has been described in considerable detail herein, the invention is not to be limited to such details as have been set forth except as may have been necessitated by the appended claims.

I claim:

1. A method for improving thermal efficiency of a fossil-fired power plant system comprising a boiler cycle in which a fossil fuel is supplied at a flow rate to be combusted to heat a working fluid, the combustion of the fuel producing effluents in an exhaust, and a turbine cycle in which the working fluid does work, the method comprising the following steps:

analyzing the fuel for its dry base chemical composition, measuring at a gas exit boundary of the power plant system, in the exhaust of the combustion process, the temperature, concentrations of $CO_2$ and $H_2O$ effluents to an accuracy of at least $\pm 0.5\%$ molar, and concentrations of $O_2$ with an accuracy at least comparable to zirconium oxide detection, measuring the net energy deposition to the working fluid being heated by the combustion process, determining, independently of the fuel flow rate, a combustion efficiency based on a stoichiometric balance of a combustion equation and a boiler absorption efficiency based on determination of non-stack losses, combining the combustion efficiency and the boiler absorption efficiency to obtain a boiler efficiency, determining an efficiency of the turbine cycle, combining the boiler efficiency and the turbine cycle efficiency to obtain the power plant system efficiency, determining in response to obtaining the boiler efficiency and the power plant system efficiency if either is degraded from predetermined parameters, and adjusting operation of the system to improve its boiler efficiency and/or its system efficiency.

2. The method of claim 1 including the steps of repetitiously adjusting an assumed water concentration in the fuel until consistency is obtained between the measured $CO_2$ and $H_2O$ effluents and computed $CO_2$ and $H_2O$ effluents determined by stoichiometrics based on the chemical composition of the fuel, thereby establishing the validity of the calculated boiler efficiency and/or system efficiency.

3. The method of claim 1 wherein the measured $CO_2$ *and H*O effluents are measured by utilizing an emissions spectral radiometer.

4. The method of claim 1 including determining whether degradations of operation are occurring in the boiler cycle, and whether stack losses are increasing by detecting decreases in iterative combustion efficiency determinations.

5. The method of claim 1 including determining whether degradations of operation are occurring in the boiler cycle due to increased radiation and convection losses, heat content remaining in the coal rejects if the fuel is coal, heat exchanger water/steam leaks, heat exchanger loss of effectiveness, and increases in other non-stack losses by detecting decreases in iterative boiler absorption efficiency determinations.

6. A method for determining and improving thermal efficiency of a fossil-fired power plant system comprising a boiler cycle in which a fossil fuel is supplied at a flow rate to be combusted to heat a working fluid, the combustion of the fuel producing effluents in an exhaust, and a turbine cycle in which the working fluid does work, comprising the following steps:

analyzing the fuel for its dry base chemical composition, measuring in the exhaust of the combustion process at the gas exit boundary of the power plant system the temperature, concentrations of $CO_2$ and $H_2O$ effluents to at least an accuracy of $\pm 0.5\%$ molar by utilizing an emissions spectral radiometer, and concentrations of $O_2$ with an accuracy at least comparable to zirconium oxide detection, measuring the net energy deposition to the working fluid being heated by the combustion process, determining, independently of the fuel mass flow rate, both a combustion efficiency as based on a stoichiometric balance of a combustion equation and a boiler absorption efficiency based on determination of non-stack losses, combining combustion efficiency and boiler absorption efficiency to obtain the boiler efficiency, repetitiously adjusting assumed water concentration in the fuel until consistency is obtained between the measured $CO_2$ and $H_2O$ effluents and those determined by stoichiometries based on the chemical concentration of the fuel for establishing validity for a calculated fuel mass flow rate and boiler efficiency, determining whether degradations from predetermined parameters are occurring in the fuel-air mixing equipment, the differential boiler fuel flows, the heat content of the fuel, and whether stack losses are increasing by detecting decreases in iterative combustion efficiency calculations, determining whether degradations from predetermined parameters are occurring due to increased radiation and convection losses, heat content remaining in the coal rejects, heat exchanger water/steam leaks, heat exchanger loss of effectiveness, and increases in other non-stack losses by detecting decreases in iterative boiler absorption efficiency calculations, and adjusting operation of the power plant system to improve its thermal efficiency and/or its system efficiency.

7. A method for determining the fuel flow rate and pollutant flow rates of a fossil-fired steam generator system having a working fluid by monitoring the operation of the steam generator system and making calculations which are derived from data obtained from the analysis of the chemical composition of the dry component of the fuel, the concentrations of the common pollutants produced from combustion, and the concentrations of $CO_2$ and superheated water produced from combustion and the fuel, comprising analyzing the fuel for its dry base chemical composition, measuring at a gas exit boundary of the steam generator system in the exhaust of the combustion process the temperature, concentrations of $CO_2$ and $H_2O$ effluents to an accuracy of at least $\pm 0.5\%$ molar, and concentrations of $O_2$ with an accuracy at least comparable to zirconium oxide detection, measuring the net energy deposition to the working fluid being heated by the combustion process, calculating, independently of the fuel flow rate, a combustion efficiency based on the stoichiometric balance of a combustion equation and a boiler absorption efficiency based on determination of non-stack losses, combining the combustion efficiency and the boiler absorption efficiency to obtain a boiler efficiency, and determining the fuel flow rate from the boiler efficiency.

8. The method of claim 7 including the steps of repetitiously changing the assumed value of water concentration in the fuel until consistency is obtained between the measured $CO_2$ and $H_2O$ effluents and computed $CO_2$ and $H_2O$ effluents determined by stoichiometries based on the chemical composition of the fuel, thereby establishing validity for the calculated fuel mass flow rate.

9. The method of claim 7 further comprising the following steps:

measuring the concentration of the common pollutants in the exhaust of the combustion process with an accuracy comparable to standard industrial practice, and determining the pollutant flow rates from the fuel mass flow rate and knowledge of the concentrations of the common pollutants.

10. The method of claim 9 wherein the common pollutants are measured by utilizing an emissions spectral radiometer.

11. The method of claim 9 wherein action is taken to adjust operation of the steam generator system to minimize pollutant concentrations effluent from the steam generator system by lowering the fuel firing rate, by mixing fuels having different sulfur contents for $SO_2$ and $SO_3$ control, by lowering the combustion flame temperature for $NO_x$ control and other such actions necessary to reduce pollutant concentrations.

12. The method of claim 9 wherein action is taken to adjust operation of the steam generator system to minimize pollutant effluent flow rates from the steam generator system by lowering the fuel firing rate, by mixing fuels having different sulfur contents for $SO_2$ and $SO_3$ control, by lowering the combustion flame temperature for $NO_x$ control, by mixing fuels having different nitrogen contents for $NO_x$ control, and other such actions necessary to reduce pollutant flow rates.

13. The method for determining fuel flow rate and pollutant flow rates of claim 9 including the steps of repetitiously changing an assumed value of water concentration in the fuel until consistency is obtained between the measured $CO_2$ and $H_2O$ effluents and the computed $CO_2$ and $H_2O$ effluents determined by stoichiometries based on the chemical composition of the fuel, thereby establishing validity for the calculated pollutant flow rates.

14. The method according to claim 7 further comprising the steps of determining a calculated heating value of the fuel based on the dry base chemical composition of the fuel and an assumed water content of the fuel, and repetitiously changing the assumed water concentration in the fuel until consistency is obtained between the measured water concentration in the fuel and the computed water concentration in the fuel, thereby establishing validity for the calculated heating value of the fuel.

15. A method for determining fuel flow, pollutant flow rates, and improving thermal efficiency of a fossil-fired steam generator power plant system comprising a boiler cycle in which a fossil fuel is supplied at a flow rate to be combusted to heat a working fluid, the combustion of the fuel producing effluents in an exhaust, and a turbine cycle in which the working fluid does work, the method comprising the following steps:

analyzing the fuel for its dry base chemical composition, measuring at a gas exit boundary of the power plant system, in the exhaust, the temperature, the concentrations of $CO_2$ and $H_2O$ effluents to a predetermined accuracy, and $O_2$ with an accuracy at least comparable to zirconium oxide detection, measuring the net energy deposition to the working fluid being heated by the combustion process, determining, independently of the fuel flow rate, a combustion efficiency based on a stoichiometric balance of a combustion equation and a boiler absorption efficiency based on determination of non-stack losses, combining the combustion efficiency and the boiler absorption efficiency to obtain a boiler efficiency, determining an efficiency of the turbine cycle, combining the boiler efficiency and the turbine cycle efficiency to obtain the power plant system efficiency, determining in response to obtaining the boiler efficiency and the power plant system efficiency if either is degraded from predetermined parameters, and adjusting operation of the power plant system to improve its boiler efficiency and/or its system efficiency.

16. The method according to claim 15 in which the concentrations of $CO_2$ and $H_2O$ effluents are measured to a predetermined accuracy of greater than $\pm 5.0\%$ molar.

17. The method according to claim 15 in which the concentrations of $CO_2$ and $H_2O$ effluents are measured to a predetermined accuracy of greater than $\pm 0.5\%$ molar.

18. The method according to claim 15 further comprising the step of determining the fuel flow rate from the boiler efficiency.

19. The method according to claim 15 further comprising the steps of measuring the concentration of the common pollutants in the exhaust of the combustion process with an accuracy comparable to standard industrial practice and determining the pollutant flow rates from the fuel mass flow rate and knowledge of the concentrations of the common pollutants.

20. The method according to claim 15 including the steps of repetitiously adjusting an assumed water concentration in the fuel until consistency is obtained between the measured $CO_2$ and $H_2O$ effluents and the $CO_2$ and $H_2O$ effluents determined by stoichiometrics based on the chemical composition of the fuel, thereby establishing the validity of the calculated boiler efficiency and/or power plant system efficiency.

* * * * *

UNITED STATES PATENT AND TRADEMARK OFFICE

CERTIFICATE OF CORRECTION

PATENT NO. : 5,367,470 
DATED : November 22, 1994
INVENTOR(S) : Fred D. Lang

It is certified that error appears in the above-identified patent and that said Letters Patent is hereby corrected as shown below:

Column 8,
Equation (19) should read as follows:

-- $m_{AF}HSL = L_G + L_{mF} + L_H + L_{mA} + L_X + L_Z + L_{CO} + L_{UH} + L_{UHC}$ (19) --

Lines 49-53, Equation (21E) is unnecessarily repeated and should be deleted.

Column 9,
Equation (26) should read as follows:

-- $HRX = HRX_{Ref} + h_A + h_z + h_F + (B_X + B_W - L_X + B_{Fan})/m_{AF} + b_A(1.0 + \beta)N_{H2O}(H_{f\text{-}H2O} + H_{fg})/(xN_{AF}) + b_Z N_{H2O}(H_{f\text{-}H2O} + H_{fg})/(xN_{AF})$ (26) --

Equation (28) should read as follows:

-- $HRX_{Ref} = HHVP + H_{f\text{-}CO2}(\alpha_0 YR + \alpha_4 + \alpha_7 + \alpha_8)/N_{AF} + H_{f\text{-}H2O}(\alpha_0 ZR + 2\alpha_2 + 2\alpha_5 + 2\alpha_9)2\ N_{AF} + H_{f\text{-}SO2}(\alpha_6 + \alpha_9)/N_{AF}$ (28) --

Column 12,
Equation (31) should read as follows:

-- $LHV_{on\text{-}line/dry} = (-178387.18\alpha_3 + 183591.92\alpha_4 + 78143.68\alpha_5 + 127691.99\alpha_6) / (N_{AF} - \alpha_2 N_{H2O})$ (31) --

Equation (33) should read as follows:

-- $HHV_{AF} = (LHV_{online/dry} + \Delta H_{Ref})(N_{AF} - \alpha_2 H_{H2O})/N_{AF} + (\alpha_2 + \alpha_5)N_{H2O}\,\Delta h_{fg}/N_{AF}$ (33) --

UNITED STATES PATENT AND TRADEMARK OFFICE

CERTIFICATE OF CORRECTION

PATENT NO. : 5,367,470
DATED : November 22, 1994
INVENTOR(S) : Fred D. Lang

It is certified that error appears in the above-identified patent and that said Letters Patent is hereby corrected as shown below:

Column 18,
Lines 53-55, claim 3 should read as follows:
3. The method of claim 1 wherein the measured $CO_2$ and $H_2O$ effluents are measured by utilizing an emissions spectral radiometer.

Signed and Sealed this

Fifteenth Day of July, 2003

JAMES E. ROGAN
*Director of the United States Patent and Trademark Office*